US005108641A

United States Patent [19]

Ahmed et al.

[11] Patent Number: 5,108,641

[45] Date of Patent: Apr. 28, 1992

[54] AQUEOUS LIQUID AUTOMATIC DISHWASHER DETERGENT COMPOSITION CONTAINING DUAL BLEACH SYSTEM

[75] Inventors: Fahim U. Ahmed, Dayton; Kathleen Bochis, East Brunswick, both of N.J.

[73] Assignee: Colgate-Palmolive Co., Piscataway, N.J.

[21] Appl. No.: 642,343

[22] Filed: Mar. 11, 1991

Related U.S. Application Data

[60] Division of Ser. No. 519,205, May 4, 1990, Pat. No. 5,076,952, which is a continuation-in-part of Ser. No. 344,732, Apr. 28, 1989, abandoned, and a continuation-in-part of Ser. No. 419,242, Oct. 10, 1989, abandoned.

[51] Int. Cl.[5] ..... C11D 3/395

[52] U.S. Cl. ..... 252/94; 252/95; 252/99; 252/135; 252/186.21; 252/187.1; 252/187.2; 252/187.26; 252/DIG. 10; 252/DIG. 14

[58] Field of Search ..... 252/95, 94, 99, 135, 252/186.21, 187.1, 187.2, 187.26, DIG. 10, DIG. 14

[56] References Cited

U.S. PATENT DOCUMENTS

| | | | |
|---|---|---|---|
| 3,519,569 | 7/1970 | Diez | 252/99 |
| 4,102,799 | 7/1978 | Finck | 252/99 |
| 4,421,669 | 12/1983 | Brichard | 252/95 |
| 4,740,327 | 4/1988 | Julemont et al. | 252/99 |
| 4,830,773 | 5/1989 | Olson | 252/99 |
| 4,904,406 | 2/1990 | Darwent et al. | 252/99 |
| 4,941,988 | 7/1990 | Wise | 252/99 |
| 4,968,446 | 11/1990 | Ahmed et al. | 252/99 |
| 4,988,452 | 1/1991 | Kinstedt et al. | 252/99 |

FOREIGN PATENT DOCUMENTS 0186234 2/1986 European Pat. Off. .

*Primary Examiner*—A. Lionel Clingman
*Assistant Examiner*—Bradley A. Swope
*Attorney, Agent, or Firm*—Richard E. Nanfeldt; Robert C. Sullivan; Murray Grill

[57] ABSTRACT

The invention discloses an aqueous liquid dishwashing detergent composition having improved cleaning performance against both proteinaceous and carbohydrate soils comprising at least one ingredient selected from the group consisting of organic detergent, detergent builder, from inhibitors and mixtures thereof, and a dual bleach system comprising a hypochlorite source sufficient to provide 0.5 to 5 wt. % available chlorine and a bromide compound which bromide compound is insoluble or only sparingly soluble in the product liquid wherein the mole ratio of bromide compound to available chlorine is 0.04 to 1.04.

16 Claims, No Drawings

AQUEOUS LIQUID AUTOMATIC DISHWASHER DETERGENT COMPOSITION CONTAINING DUAL BLEACH SYSTEM

RELATED APPLICATION

This is a continuation of application Ser. No. 519,205 filed May 4, 1990, now U.S. Pat. No. 5,076,952, which is a continuation-in-part of applicants' prior applications Ser. No. 344,732, filed Apr. 28, 1989, now abandoned and Ser. No. 419,242, filed Oct. 10, 1989, now abandoned.

FIELD OF THE INVENTION

The present invention relates to an aqueous liquid automatic dishwasher detergent composition having improved cleaning performance against difficult to remove soils. The present invention is more particularly directed to a stable aqueous liquid detergent composition containing a dual bleach system for use in an automatic dishwasher to clean dishware, glassware, cookware and the like.

The present invention also relates to an improved aqueous liquid composition and to a method of making and using the composition.

BRIEF DESCRIPTION OF THE INVENTION

The present invention is directed to an aqueous liquid automatic dishwasher detergent composition having improved cleaning performance for proteinaceous and carbohydrate soils. The aqueous liquid detergent composition contains a chlorine bleach source and a bromide source. The detergent composition more particularly contains a source of hypochlorite ion and a source of bromide ion. The bromide source is insoluble or only sparingly soluble in the aqueous product liquid. The chlorine bleach source can be a hypochlorite compound or a chlorine compound that reacts with water to form hypochlorite. When the detergent composition is added to a wash bath the bromide source dissolves and then reacts in situ with a portion of the hypochlorite ion to form hypobromite ion which is a powerful oxidizing agent.

The newly formed hypobromite ion is an effective agent for cleaning carbohydrate soils and the remaining unreacted hypochlorite ion is an effective agent for cleaning proteinaceous soils. The hypobromite ion is highly reactive and is unstable in storage. Thus the hypobromite ion must be formed in the washbath just before use.

The present invention specifically relates to aqueous liquid automatic dishwashing detergent compositions having improved cleaning performance against proteinaceous and starchy carbohydrate soils on dishware, glassware, cookware and the like, particularly cooked on and baked on soils.

The aqueous liquid compositions are readily dispersed in the wash bath.

The present invention also relates to thixotropic aqueous liquid compositions with improved physical stability. The invention relates to the use of long chain fatty acids, metal salts of fatty acids and clay as thickening agents for forming stable gel-like liquid suspensions suitable for use as liquid automatic dishwasher detergent compositions.

A preferred embodiment of the present invention relates to aqueous liquid automatic dishwasher detergent compositions having thixotropic properties, improved anti-filming, anti-spotting and physical stability properties, which are readily dispersible in the washing medium to provide effective cleaning of dishware, glassware, china and the like.

PRIOR ART

Commercially available household-machine dishwasher detergents provided in powder or liquid form have the disadvantage of not being effective in cleaning both proteinaceous and starchy carbohydrate soils. The cooked on and baked on proteinaceous and starchy carbohydrate soils are particularly hard to remove. Though some detergent compositions have been found to be effective in removing proteinaceous soils and others have been found effective in removing starchy carbohydrate soils, none have been found effective in removing both proteinaceous and starchy carbohydrate soils from dishware, glassware, cookware and the like.

For effective use, it is generally recommended that the aqueous liquid automatic dishwashing detergent, hereinafter also designated LADD, contain (1) sodium tripolyphosphate (NaTPP) to soften or tie up hard-water minerals and to emulsify and/or peptize soil; (2) sodium silicate to supply the alkalinity necessary for effective detergency and to provide protection for dishware, such as fine china and protection against machine corrosion; (3) sodium carbonate, generally considered to be optional, to enhance alkalinity; (4) a chlorine-releasing agent to aid in cleaning; (5) a surfactant and (6) a defoamer to reduce foam, thereby enhancing machine efficiency. See, for example, SDA Detergents in Depth, "Formulations Aspects Of Machine Dishwashing," Thomas Oberle (1974). Cleansers approximating to the afore-described compositions are mostly liquids or powders. Generally, such compositions omit hypochlorite bleach, since it tends to react with other chemically active ingredients, particularly surfactant, thereby impairing its effectiveness.

The most difficult food soils to remove from dishware, cookware and utensils are proteinaceous and starchy carbohydrate soils. The proteinaceous soils can be in the form of baked on or cooked on milk, meats and egg soils. The starchy carbohydrate soils can be in the form of baked on or cooked on starchy carbohydrates such as rice, spaghetti, pasta, oatmeal, porridge, bread, cake and the like.

These two types of food soils are very tenaciously bound to the dishware, cookware and utensil substrates and are very difficult to clean without scrubbing.

Proteinaceous materials, for example, egg protein can be removed by appropriate concentrations of, for example, sodium hypochlorite bleach. However, dishwasher detergent compositions containing hypochlorite ion perform poorly on starchy carbohydrate soils.

The hypobromite ion is a strong oxidizing agent, but is so reactive that it is chemically unstable in detergent compositions. Bromide ion when contacted with hypochlorite in an aqueous alkaline medium wash bath reacts to form hypobromite. The hypobromite effectively degrades starchy carbohydrates.

However, if too much bromide ion is present in the wash bath, it will substantially reduce the hypochlorite ion concentration and/or will completely remove the hypochlorite from the wash bath and the proteinaceous soils are not removed.

If an insufficient amount of bromide ion is present in the wash bath the starchy carbohydrate soils are not removed.

The problem to be solved was to formulate an aqueous liquid dishwasher detergent composition that was stable in storage and was effective in a wash bath in removing both proteinaceous and starchy carbohydrate soils.

Applicants in their copending applications Ser. No. 344,732, filed Apr. 28, 1989 and Ser. No. 419,242 filed Oct. 10, 1989, have described a dual bleach powder and nonaqueous liquid automatic dishwasher detergent compositions, respectively. The copending applications are incorporated herein by reference thereto.

In the Diez U.S. Pat. No. 3,519,569 there is disclosed an abrasive scouring cleaner containing as essential ingredients a water soluble siliceous abrasive material, a hypochlorite-chlorine liberating compound, a water soluble detergent compound and an alkali metal bromide.

The Finck U.S. Pat. No. 4,102,799 discloses an alkaline automatic dishwasher detergent composition which is essentially free of inorganic phosphates and which consists essentially of a citrate compound, and one or more inorganic builder salts such as silicates, carbonates and/or sulfate. The composition can also contain one or more bleaching agents which are capable of liberating hypochlorite and/or hypobromite on contact with aqueous media.

The Hartman European Patent Application No. 0,186,234 discloses an automatic dishwasher powder detergent composition comprising a detergent builder, a source of hypochlorite, a low-sudsing nonionic surfactant, an anti-sudsing agent and an alkali metal or alkaline earth metal bromide.

ADVANTAGES OVER THE PRIOR ART

The detergent compositions of the present invention overcome many of the prior art problems. Because of the addition of a small effective amount of a bromide to the compositions, which generates hypobromite in the wash bath the composition can be used to remove both proteinaceous and starchy carbohydrate soils from dishware, glassware, cookware and the like. The detergent composition has the additional advantages of being stable in storage and readily dispersible in the dishwashing machines. The aqueous liquid compositions of the present invention are easily pourable, easily measured and easily put into the dishwashing machines.

In accordance with the present invention a stable aqueous liquid dishwashing detergent composition containing a balanced amount of hypochlorite ion and hypobromite ion is advantageously provided such that the composition efficiently and effectively cleans both proteinaceous and starchy carbohydrate soils from dishware, glassware, cookware and utensils in an automatic dishwashing machine.

The aqueous liquid detergent compositions of the present invention are stable in storage, and readily dispersed in the washing machine.

OBJECTS OF THE PRESENT INVENTION

It is an object of the present invention to provide an aqueous liquid automatic dishwasher detergent composition that has improved cleaning performance against difficult to remove proteinaceous and starchy carbohydrate soils.

It is another object of the invention to provide an aqueous liquid detergent composition which is stable in storage, does not degrade or decompose and is readily dispersible in the dishwashing water.

Another object of the present invention is to prepare an aqueous liquid automatic dishwasher detergent composition which contains both a chlorine bleach source and a bromide ion (salt) source.

Another object of the present invention is to prepare an aqueous liquid automatic dishwasher detergent composition which on addition to a wash bath dissolves the bromide source and generates a balanced amount of hypochlorite ions and hypobromite ions in the wash bath which are strong oxidizing agents and together are effective in cleaning both proteinaceous and starchy carbohydrate soils.

A further object of the invention is to provide a method of washing dishware, glassware, cookware and the like in an automatic dishwashing machine using a dual bleach system detergent composition which is effective in removing both proteinaceous and starchy carbohydrate soils.

A still further object of the invention is to provide a method of washing dishware, glassware, cookware and the like in an automatic dishwashing machine using an aqueous liquid detergent composition by which method both proteinaceous and starchy carbohydrate soils are efficiently and effectively removed from dishware, glassware, cookware and the like.

It is a further object of this invention to provide stable aqueous liquid detergent dual bleach compositions, especially automatic dishwasher detergent compositions, by incorporating in the compositions a source of chlorine bleach and a small effective amount of an insoluble or only sparingly soluble bromide compound.

A still further object of the invention is to provide a method of washing dishware, glassware, china and the like in an automatic dishwashing machine using a thixotropic aqueous liquid detergent composition containing a dual bleach system by which method the dishware, glassware, china and the like are effectively and efficiently cleaned.

It is a further object of this invention to provide stable thixotropic aqueous liquid compositions, especially automatic dishwasher detergent compositions, by incorporating in the aqueous suspension a small effective amount of a dual bleach system. There can also be added a minor amount of a fatty acid, metal salt of a fatty acid and/or clay thixotroic thickener effective to inhibit the settling of suspended particles and to prevent phase separation.

DETAILED DESCRIPTION OF THE INVENTION

These and other objects of the invention which will become more readily understood from the following detailed description of the invention and preferred embodiments thereof are achieved by incorporating in the detergent composition a source of chlorine bleach and a small but effective amount of an insoluble or only sparingly soluble bromide compound as the dual bleach system.

In accordance with the present invention there is provided an aqueous liquid automatic dishwasher detergent composition which includes, on a weight basis;

(a) 8 to 40% organic or inorganic builder salt;

(b) 2.5 to 40% sodium silicate;

(c) chlorine bleach compound in an amount to provide 0.5 to 5% available chlorine;

(d) sufficient bromide compound to provide a bromide to available chlorine mole ratio of 0.04 to 1.04;

(e) 0 to 30% alkali metal carbonate;

(f) 0.1 to 5% chlorine bleach stable, water dispersible organic detergent active material;

(g) 0.1 to 5% chlorine bleach stable foam depressant;

(h) 0.02 to 3.5% clay thixotropic thickener;

(i) 0.5 to 5% fatty acid or salt thixotropic thickener, and (j) 25 to 75% water.

The mole ratio of the bromide to available chlorine is important in obtaining the improved benefits realized from the present invention.

The present invention also provides a method for cleaning dishware, glassware and cookware in an automatic dishwashing machine in aqueous wash bath containing an effective amount of a thixotropic aqueous liquid automatic dishwasher detergent (LADD) composition as described above. According to this aspect of the invention, the LADD composition can be readily poured into the dispensing cup of the automatic dishwashing machine and will remain within the dispensing cup until subjected to the water spray from the dishwashing machine.

The invention will now be described in greater detail by way of specific embodiments thereof.

In accordance with the present invention an improved aqueous liquid automatic dishwasher detergent composition is prepared by incorporating small amounts of an insoluble or only sparingly soluble bromide containing compound in a dishwasher composition containing a source of hypochlorite ion. The term sparingly soluble as used herein is intended to mean that the bromide compound is less than 3% soluble in the product liquid and preferably less than 0.5% soluble in the product liquid. However, when the composition is added to a warm or hot dishwasher wash bath the bromide compound dissolves and then reacts with a portion of the hypochlorite and the bromide is converted to hypobromite, a strong oxidizing agent.

Thixotropic cleaning compositions are highly viscous in a quiescent state, bingham plastic in nature and have relatively high yield values. When subjected to shear stresses, however, such as being shaken in a container or squeezed through an orifice, they quickly fluidize and upon cessation of the applied shear stress, quickly revert to high viscosity/bingham plastic state.

The thixotropic aqueous liquid ADD compositions are low foaming, are readily soluble in the washing medium and most effective at pH values best conducive to improved cleaning performance, viz, pH 10.5 to 13.5. The compositions are normally of gel consistency, i.e. a highly viscous, opaque gel-like material having bingham plastic character and thus relatively high yield values. Accordingly, a definite shear force is necessary to initiate or increase flow, such as would be obtained within the agitated dispenser cup of an energized automatic dishwasher. Under such conditions, the composition is quickly fluidized and easily dispersed. When the shear force is discontinued, the fluid composition quickly reverts to a highly viscous, bingham plastic state, closely approximately its prior consistency.

The physical stability of the composition is improved by the addition of a fatty acid, metal salt of a fatty acid and/or clay thixotropic thickener. In a preferred embodiment of the invention there is added to the composition a sufficient amount of long chain fatty acid or metal salt of a long chain fatty acid or either of the foregoing in admixture with a clay thixotropic thickener to provide a thixotropic index of about 2.5 to 10 and to inhibit settling of the suspended particles, such as alkali metal salts, etc.

The aqueous thixotropic LADD products exhibit rheological properties as evaluated by testing product viscosity as a function of shear rate. The compositions exhibited higher viscosity at a low shear rate and lower viscosity at a high shear rate, the data indicating efficient fluidization and gellation well within the shear rates within the standard dishwasher machine. In practical terms, this means improved pouring and processing characteristics as well as less leaking in the machine dispenser-cup, compared to prior liquid or gel LADD products. For applied shear rates corresponding to 3 to 30 rpm, viscosities (Brookfield) correspondingly ranged from about 10,000 to 30,000 cps to about 3,000 to 7,000 cps, as measured at room temperature by means of an LVT Brookfield viscometer after 3 minutes using a No. 4 spindle. A shear rate of 7.4 $sec^{-1}$ corresponds to a spindle rpm of about 3. An approximate 10-fold increase in shear rate produces about a 3- to 9-fold reduction in viscosity. The property of aqueous thixotropic LADD products is summarized in terms of a thixotropic index (TI) which is the ratio of the apparent viscosity at 3 rpm and at 30 rpm. The prior compositions have a TI of from 2 to 10. The LADD compositions should exhibit substantial and quick return to prior quiescent state consistency when the shear force is discontinued.

In terms of apparent viscosity, it has been ascertained that so long as the viscosity at room temperature (22°±1° C.) measured in a Brookfield Viscosimeter HATD, using a number 4 spindle at 20 rpm, is less than about 20,000 cps, the composition can be readily shaken so that a thixotropic composition can be easily "fluidized" or "liquefied" to allow the product to be dispensed through a conventional squeeze tube bottle or other convenient dispenser.

The present invention is based upon the surprising discovery that substantially improved cleaning properties can be obtained by adding to the thixotropic aqueous liquid detergent composition a small effective amount of the dual bleach system of the present invention. The physical stability, i.e., resistance to phase separation, settling, etc. can be achieved by adding to the composition a small effective amount of a thixotropic thickener and stabilizing agent.

The present invention is based upon the surprising and unexpected discovery that substantially improved cleaning performance for both proteinaceous and starchy carbohydrate soils can be obtained by adding to an aqueous liquid detergent composition a source of hypochlorite and a small effective amount of a bromide compound which when added to the wash bath form a hypochlorite and hypobromite dual bleach system.

Chlorine Bleach Compound

Hypochlorite generating compounds suitable for use in the compositions of the present invention are those water soluble dry solid materials which generate hypochlorite ion on contact with, or dissolution in, water. The preferred hypochlorite compounds are alkali and alkaline earth hypochlorites.

The hypochlorite generating compounds are generally soluble in the product composition. Examples thereof are the dry, particulate heterocyclic N-chlorimides such as trichlorocyanuric acid, dichlorocyanuric acid and salts thereof such as sodium dichlorocyanurate and potassium dichlorocyanurate. The corresponding dichloroisocyanuric and trichloroisocyanic acid salts can also be used. Other N-chloroimides may be used such as N-chlorosuccinimide, N-chloromalonimide, N-chlorophthalimide and N-chloronaphthalimide. Additional suitable N-chloroimides are the hydantoins such as 1,3-dichloro-5,5-dimethylhydantion;
N-monochloro-C,C-dimethylhydantoin;
methylene-bis (N-chloro-C,C-dimethylhydantoin);
1,3-dichloro-5-methyl-5-isobutylhydantoin;
1,3-dichloro-5-methyl-5-ethylhydantoin;
1,3-dichloro-5,5-diisobutylhydantoin;
1,3-dichloro-5-methyl-5-n-amylhydantoin;

and the like. Other useful hypochlorite-liberating agents are trichloromelamine and dry, particulate, water soluble anhydrous inorganic salts such as lithium hypochlorite and calcium hypochlorite. The hypochlorite liberating agent may, if desired, be a stable, solid complex or hydrate such as sodium p-toluene-sulfo-chloramine-trihydrate (choramine-T), sodium benzene-sulfo-chloramine-dihydrate, calcium hypochlorite tetrahydrate, or chlorinated trisodium phosphate containing 0.5 to 5% available chlorine produced by combining trisodium phosphate in its normal $Na_3PO_4.12H_20$ form and an alkali metal hypochlorite (e.g., sodium hypochlorite).

The preferred sources of hypochlorite are dichloro- and trichloroisocyanurates, sodium hypochlorite, lithium hypochlorite, calcium hypochlorite and chloramine-T (p-Toluenesulfochloramine).

Typically the instant chlorine-liberating agents, such as sodium dichloroisocyanurate dihydrate, are employed in a proportion of about 1 to 15% by weight of the composition, and preferably about 1.0 to 10% and more preferably 2 to 6.5%. Sodium hypochlorite chlorine liberating agent is employed in a proportion of about 3.6 to 36% by weight of the composition, and preferably about 4.0 to 29% and more preferably 4 to 25%.

The composition should contain sufficient chlorine bleach compound to provide about 0.5 to 5.0% by weight of available chlorine, as determined, for example, by acidification of the composition with sulfuric acid and iodometric titration with sodium thiosulfate monitored by a potentiometer. A composition containing about 0.9 to 9% by weight of sodium dichloroisocyanurate dihydrate contains or provides about 0.5 to 5% available chlorine. A composition containing about 1.8 to 6.25% by weight sodium dichloroisocyanurate dihydrate contains about 1 to 3.5% by weight of available chlorine and is especially preferred. A composition containing about 1.6 to 5.6% by weight calcium hypochlorite contains about 1 to 3.5% by weight available chlorine. A composition containing about 3.6 to 36% by weight of sodium hypochlorite contains about 0.5 to 5% by weight of available chlorine. A composition containing about 7.4 to 22.20% by weight of sodium hypochlorite contains about 1 to 3% by weight of available chlorine.

Desirably the proportion of chlorine-liberating compound employed will be such as to yield a product which contains from about 0.5% to about 5% available chlorine on a total weight basis, preferably 1 to 4% and more preferably 1 to 3.5% available chlorine. The amount of available chlorine corresponds to 14 to 141 milli mole %, preferably 28 to 113 milli mole % and more preferably 14 to 99 milli mole % chlorine.

Bromide Compound

The bromide compounds that can be used in accordance with the present invention are those that are insoluble or only sparingly soluble in the aqueous liquid product composition, and that are soluble in the larger volume of the water washbath at the wash temperatures of 100° to 140° F., preferably 130° to 140° F. (38° to 60° C., preferably 48° or 54° to 60° C.). That is, the bromide compounds are soluble in the warm or hot water wash bath of higher water volume.

Organic compounds containing bromide ion, such as polymer bound bromide compounds, quaternaryammonium and phosphonium bromides (carbon length from $C_1$ to $C_{20}$) salts can be used. Sparingly soluble (e.g. insoluble in the aqueous product) bromide salts are best suited for aqueous liquid LADD compositions as they will suppress the formation of the active hypobromite in the product liquid, but will generate it in the wash cycle due to higher temperature and increased water volume in the wash cycle.

Bromide salts that are soluble in the aqueous LADD product liquid cannot be used, because they would react immediately to form the highly reactive and unstable hypobromite, which degrades quickly, before the shelf life of the LADD product.

A readily commercially available source of bromide compounds that can be used are the sparingly water soluble or the water insoluble long chain alkyl hydrocarbon quaternaryammonium bromide compounds having the following formula.

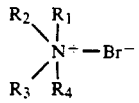

(I)

Where $R_1$ is a $C_{12}$ to $C_{22}$ alkyl, preferable $C_{16}$–$C_{18}$ alkyl.

Where $R_2$ is a $C_1$ to $C_{22}$ alkyl, preferably $C_1$–$C_2$ or $C_{16}$–$C_{18}$ alkyl.

Where $R_3$ is a $C_1$ to $C_4$ alkyl, preferably $C_1$–$C_2$ alky.

Where $R_4$ is a $C_1$ to $C_4$ alkyl, preferably $C_1$–$C_2$ alkyl, or $C_1$–$C_2$ alkyl aromatic.

Specific compounds coming within this formula are:

Dicetyldimethylammonium bromide
Dicetylethylmethylammonium bromide
Cetyldimethylethylammonium bromide
Cetyltrimethylammonium bromide
Distearyldimethylammonium bromide
Stearyldiethylmethylammonium bromide
Stearyldimethylethylammonium bromide
Stearyltrimethylammonium bromide
Stearyldimethylbenzylammonium bromide
Myristyltrimethylammonium bromide
Benzyldimethyldecylammonium bromide
Tetraoctadecylammonium bromide
Tetradecylammonium bromide
Octadecyltrimethylammonium bromide The phosphonium bromide salts having the following formula can also be used

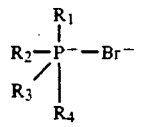

(II)

The values for $R_1$, $R_2$, $R_3$ and $R_4$ are the same as defined in the above formula I quaternaryammonium bromide compounds, with the difference that $R_1$, $R_2$ and $R_3$ can also each by phenyl. Example of suitable phosphonium bromide salts that can be used are:

Hexadecyltributylphosphonium bromide
Ethyltriphenylphosphonium bromide
Butyltriphenylphosphonium bromide
Methyltrioctylphosphonium bromide
Tetraphenylphosphonium bromide There can also be used the polymer bound quaternaryammonium bromide compounds of the Amberlite Series such as IRA 404 Resin of the following formula:

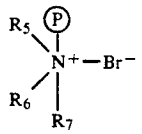

(III)

Ⓟ is a resin polymer which can be a homopholymeric or copolymeric polyacrylate or polystyrene. $R_5$, $R_6$ and $R_7$ can each be aryl or alkyl aryl, or $C_1$ to $C_4$ hydrocarbons.

Suitable commercially available polymer bound resin compounds are:

1. Amberlyst A-26 having the formula Ⓟ—$C_6H_4CH_2N^+(CH_3)_3Br^-$ and is a polymer bound benzyltrimethyl quaternaryammonium bromide. The Amberlyst A-26 contains 3.2 milli mole of bromide per gram of resin.

2. Amberlite IRA 402 Resin styrene/divinylbenzene copolymer has the formula Ⓟ—$C_6H_4CH_2N^+(CH_3)_3Br^-$. Amerlite IRA 402 Resin contains 4.2 milli mole of bromide per gram.

3. Amberlite IRA 458 Resin has the formula Ⓟ-R-$N^+(CH_3)_3Br^-$ in which the P polymer is polyacrylate polymer and the R substituent is alkyl. Amberlite IRA 458 contains 5 milli mole of bromide per gram of resin.

4. Hexyltributylphosphonium bromide on polymer support has the formula Ⓟ—$(CH_2)_6$—$P^+(C_4H_9)_3Br$ and contains 0.83 milli mole of bromide per gram of resin.

5. Tributylmethylphosphonium bromide has the formula Ⓟ—$CH_2P^+(C_4Ha)_3Br^-$, where p is polystyrene cross-linked with 1% divinylbenzene and contains 0.9 milli mole of bromide per gram of resin.

6. Tributylmethylammonium bromide polymer bound resin has the formula Ⓟ—$CH_2N^+(C_4H_9)_3Br^-$, where Ⓟ- is polystyrene crosslinked with 1% divinylbenzene and contains 0.85 milli mole of bromide per gram of resin.

In another embodiment of the invention readily water soluble bromide compounds, such as alkali and alkaline earth metal bromides can be used. However, in order to prevent these readily soluble bromide compounds from dissolving in the aqueous liquid product and reacting prematurely with the hypochlorite, the readily soluble bromide compounds are encapsulated in a protective coating that is insoluble or only sparingly soluble in the liquid product.

The protective coating is selected such that the coating is insoluble or only sparingly soluble in the concentrated aqueous liquid product. The protective coating, however, is also selected such that it is soluble in the dilute larger volume of wash bath water at temperatures of 100° to 140° F., preferably 120° or 130° to 140° F. (38° to 60° C., preferably 48° or 54° to 60° C.).

Suitable encapsulation materials which meet these criteria and the method of encapsulation are known in the art and are described in Brichard U.S. Pat. No. 4,421,669, which is incorporated herein in its entirety by reference thereto.

The bromide source or compound in this protective coating embodiment can be a water soluble bromide compound which provides a ready source of bromide ions on dissolution of the protective coating in the wash bath water. It is preferred to employ alkali metal bromides such as sodium bromide, lithium bromide, and potassium bromide, although alkaline earth metal bromides such as calcium bromide and magnesium bromide may be employed in those instances in which these water hardness-producing cations are not objectionable.

In accordance with this embodiment of the present invention the readily water soluble alkali metal bromide compounds are coated using coating agents that are insoluble in water and that melt at the temperature in the wash water of the automatic dishwashing machine. The alkali metal bromide compounds are stabilized by the coating while in the aqueous product liquid and the coating dissolves at the elevated tempratures in the automatic dishwashing machine to release the water soluble alkali metal bromide to the dishwashing composition. Protective coating agents are chosen which have an initial melting point of between 38° and 60° C., and preferably between 48° and 60° C. That is, the coatings melt at the wash temperature in the dishwashing machine. The coating agents that can be used can be of various types. Organic compounds compatible with the alkali metal bromide compounds are generally chosen. These are characterized by solubility in water at ambient temperature of less than 5%, preferably less than 1% by weight. These coating agents are generally chosen from waxes of the types available commercially. The waxes that can be used according to the invention can be vegetable, animal, mineral or synthetic origin. They can be based on various type of products such as high molecular weight hydrocarbons, fatty acids and their derivatives, such as esters and amides, and fatty alcohols. The best results are obtained with waxes based on high molecular weight hydrocarbons.

The fatty acids present in the waxes that can be used are generally natural or synthetic acids containing at least 10 carbon atoms. Waxes containing saturated fatty acids containing at least 10 carbon atoms or saturated fatty acids containing at least 18 carbon atoms can be used. Waxes containing saturated fatty acids containing 10 to 30 carbon atoms are preferred.

Derivatives of fatty acids present in the waxes that can be used can be of various types. Generally they are esters of fatty acids and compounds chosen from monohydric or polyhydric alcohols and epoxides, and amides of fatty acids, as well as substituted and unsubstituted aromatic, aliphatic or acyclic amines.

The esters of fatty acids present in the waxes are preferably esters of alcohols chosen from long chain alcohols such as alcohols containing 10 to 30 carbon atoms, glycols, ethylene glycols, glycerol, and carbohydrates or esters of epoxides such as ethylene oxide and propylene oxide.

The fatty alcohols present in the waxes that can be used are preferably natural or synthetic alcohols containing at least 12 carbon atoms. Suitable fatty alcohols contain 12 to 35 carbon atoms. The high molecular weight hydrocarbons present in the waxes are those having average molecular weights varying between 300 and 800 as aliphatic hydrocarbons and olefin polymers. Suitable waxes are microcrystaline waxes and paraffin waxes.

Particles of coating agents used can be of a size generally between 0.05 and 10 mm average diameter, preferably between 0.1 and 5 mm.

The quantity of coating agent used to coat the alkali metal bromides is generally between 0.1 and 10% of the weight of the alkali metal bromide compound to be stabilized and preferably between 0.1 and 3% by weight of the alkali metal bromide compound.

The particles of alkali metal bromide compound that are stabilized by coating with the waxes can have an average diameter of between 0.1 and 2 mm, preferably between 0.2 and 1 mm.

The alkali metal bromide compound particles are stabilized by coating them with a protective coating of wax particles using the coating process described in the above mentioned Brichard U.S. Pat. No. 4,421,669.

The bromide compound is employed in an amount which is about the same or less than the molar equivalent of available chlorine present in the product liquid, e.g., the mole ratio of bromide to available chlorine in the product liquid is in the range of 0.04 to 1.04, preferably less than 1.0, for example 0.05 to 0.95, or 0.05 to 0.90 and typically 0.05 to 0.75. Mole ratios of bromide ion to available chlorine of 0.05 to 0.095 can also advantageously be used.

The bromide compounds, whether as a water insoluble bromide compound or as a water soluble bromide compound with a protective coating are used in amounts to provide in the detergent composition 0.56 to 147 milli moles %, preferably 1.4 to 102 milli moles % and more preferably 1.4 to 74 milli mole % of bromide.

A balanced aqueous liquid detergent composition is obtained which contains a small effective amount of the bromide which in the aqueous wash bath reacts with the hypochlorite to form a sufficient amount of hypobromite to remove the starchy carbohydrate soil and to leave a sufficient amount of hypochlorite ion in the wash bath to remove the proteinaceous soil.

Thus, the weight percent available chloride and the mole ratio of bromide to available chloride are important features of the present invention.

THIXOTROPIC THICKENERS

The thixotropic thickeners or suspending agents that can be used in accordance with the present invention to provide the aqueous medium with thixotropic properties may be organic, for example, fatty acid or fatty acid metal salts or inorganic colloid forming clay materials. The thixotropic thickeners should be stable to high alkalinity and stable to chlorine bleach compounds such as sodium hypochlorite. The preferred thixotropic thickeners comprise the fatty acids, the fatty acid polyvalent metal salts and the inorganic, colloid-forming clays of smectite and/or attapulgite types. The amount of the thixotropic thickener used will depend on the particular thickener used, but sufficient thickener is added to the formulation to provide the composition with a thixotropy index of about 2.5 to 10.

The preferred fatty acid thixotropic thickeners are the higher aliphatic fatty monocarboxylic acids having from about 8 to about 22 carbon atoms, more preferably from about 10 to 20 carbon atoms, and especially preferably from about 12 to 18 carbon atoms, inclusive of the carbon atom of the carboxyl group of the fatty acid. The aliphatic radicals are saturated and can be straight or branched. Straight chain saturated fatty acids are preferred. Mixtures of fatty acids may be used, such as those derived from natural sources, such as tallow fatty acid, coco fatty acid, soya fatty acid, etc., or from synthetic sources available from industrial manufacturing processes. The fatty acids should be fully saturated in order to prevent undesireable reaction with the hypochlorite.

Thus, examples of the fatty acids which can be used as thickeners include, for example, decanoic acid, lauric acid, dodecanoic acid, palmitic acid, myristic acid, stearic acid, oleic acid, eicosanoic acid, tallow fatty acid, coco fatty acid, soya fatty acid and mixtures of these acids. Stearic acid and mixed fatty acids, e.g. coco fatty acid, are preferred.

Generally, the amounts of the fatty acid thixotropic agent that can be used are in the range of from about 0.02 to 3%, preferably from about 0.03 to 2.5%, especially preferably from about 0.05 to 2.0%, provide the desired long term stability and absence of phase separation.

The metal salts of the above fatty acids can also be used in the present invention as thixotropic thickener agents. Suitable fatty acid, metal salt fatty acid and clay thixotropic thickeners are disclosed in U.S. Pat. No. 4,889,653 dated Dec. 16, 1989 in the name of Ahmed and Buck, which is incorporated herein in its entirety by reference thereto.

The preferred metals are the polyvalent metals such as magnesium, calcium, aluminum and zinc. The calcium and magnesium salts are especially preferred as generally safe food additives.

Many of the metal salts are commercially available. For example, the aluminum salts are available in the triacid form, e.g. aluminum stearate as aluminum tristearate, $Al(C_{17}—H_{35}COO)_3$. The monoacid salts, e.g. aluminum monostearate, $Al(OH)_2(C_{17}H_{35}COO)$ and diacid salts, e.g. aluminum distearate, $Al(OH)C_{17}H_{35}COO)_2$, and mixtures of two or three of the mono-, di- and triacid salts can be used for those metals, e.g. Al, with valences of +3, and mixtures of the mono- and diacid salts can be used for those metals, e.g. Zn, with valences of +2.

Calcium stearate, i.e. calcium distearate, magnesium stearate, i.e. magnesium distearate, aluminum stearate, i.e. aluminum tristearate, and zinc stearate, i.e. zinc distearate, are the preferred polyvalent fatty acid salt stabilizers.

Generally, the amounts of the polyvalent metal fatty acid salt stabilizing agents in the range of from about 0.02 to 2%, preferably from about 0.06 to 1.5%, especially preferably from about 0.08 to 1.0%, provide the long term stability and absence of phase separation upon standing or during transport at both low and elevated temperatures as are required for a commercially acceptable product.

There may also be used in the present invention the conventional inorganic thixotropic clay thickeners. The clay thickeners may be used in small amounts in combination with the fatty acid thickeners or in combination with fatty acid polyvalent metal salt thickeners. The clay thickeners, however, may be used by themselves as the thixotropic thickeners.

The preferred clay thickeners comprise the inorganic, colloid forming clays of smectite and/or attapulgite types.

Smectite clays include montmorillonite (bentonite), hectorite, attapulgite, smectite, saponite, and the like. Montmorillonite clays are preferred and are available under tradenames such as Thixogel (Registered Trademark) No. 1 and Gelwhite (Registered Trademark) GP, H, etc., from Georgia Kaolin Company; and Eccagum (Registered Trademark) GP, H, etc., from Luthern Clay Products. Attapulgite clays include the materials commercially available under the tradename Attagel (Registered Trademark), i.e. Attagel 40, Attagel 50 and Attagel 150 from Engelhard Minerals and Chemicals Corporation. Mixtures of smectite and attapulgite types in weight ratios of 4:1 to 1:5 are also useful herein. Thickening or suspending agents of the foregoing types are well known in the art.

When used in combination with the fatty acids or the fatty acid polyvalent metal salts, the clay thixotropic thickeners are used in amounts of 0.1 to 3%, preferably 0.1 to 2.5% and more preferably in amounts of 0.1 to 2%.

When the clay thixotropic thickeners are used alone as the thixotropic thickener agent they can be used in amounts of about 1.5 to 8%, preferably 2 to 5% and more preferably 1 to 2.5% by weight of the formulation.

It is preferred herein that the pH of the aqueous thixotropic liquid ADD composition product liquid be at least about 9.5, more preferably from about 10.5 to 13.5 and most preferably at least about 11.5. At the relatively lower pH values, the LADD product is too viscous, i.e. solid-like, and thus not readily fluidized under the shear-force levels created within the dispenser cup under normal machine operating conditions. NaOH is thus often added to increase the pH to within the above ranges, and to increase flowability properties. Caustic soda (NaOH) serves the further function of neutralizing the phosphoric or phosphonic

Foam Inhibitors

Foam inhibition is important to increase dishwasher machine efficiency and minimize destabilizing effects which might occur due to the presence of excess foam within the washer during use. Foam may be sufficiently reduced by suitable selection of the type and/or amount of detergent active material, the main foam-producing component. However, it is generally preferred to include a chlorine bleach stable foam depressant or inhibitor. Particularly effective are the alkyl phosphonic acid esters of the formula

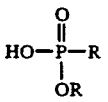

available, for example, from BASF-Wyandotte (PCUK-PAE), and especially the alkyl acid phosphate esters of the formula

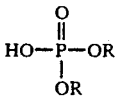

available, for example, from Hooker (SAP) and Knapsack (LPKN-158), in which one or both R groups in each type of ester may represent independently a $C_{12-20}$ alkyl group. Mixtures of the two types, or any other chlorine bleach stable types, or mixtures of mono- and di-esters of the same type, may be employed. Especially preferred is a mixture of mono- and di-$C_{16-18}$ alkyl acid phosphate esters such as monostearyl/distearyl acid phosphates 1.2/1 (Knapsack). When employed, proportions of 0.01 to 5 wt. %, preferably 0.1 to 5 wt. %, especially about 0.1 to 0.5 wt. %, of foam depressant in the composition are typical. Other defoamers which may be used include, for example, the known silicones.

The sodium silicate, which provides alkalinity and protection of hard surfaces, such as fine china, is employed in an amount ranging from about 2.5 to 40 wt. %, preferably about 8 to 35 wt. %, and more preferably about 10 to 30 wt. %, in the composition. The sodium silicate also protects the washing machine from corrosion. The sodium silicate can have a $Na_2O:SiO_2$ ratio of 1.6/1 to 1/3.2. The sodium silicate can be added in the form of an aqueous solution, preferably having an $Na_2O:SiO_2$ ratio of from 1/1 to 1/2.8, for example, 1/2.4. Potassium silicates of the same ratios can also be used. The preferred alkali metal silicates are sodium disilicate and sodium metasilicate.

Most of the other components of the composition, for example, the hypochlorites and foam depressant can be added in the form of dry powders or aqueous dispersions or solutions.

Surfactant Detergents

The liquid nonionic surfactant detergents that can be used in the practice of the present are preferably the low foam poly-lower alkoxylated lipophiles.

Useful nonionics are represented by the low foam Plurafac series from BASF Chemical Company which are the reaction product of a higher linear alcohol and a mixture of ethylene and propylene oxides, containing a mixed chain of ethylene oxide and propylene oxide, terminated by a hydroxyl group. Examples include a $C_{13}$–$C_{15}$ fatty alcohol condensed with 6 moles ethylene oxide and 3 moles propylene oxide, a $C_{13}$–$C_{15}$ fatty alcohol condensed with 7 moles propylene oxide and 4 moles ethylene oxide and a $C_{13}$–$C_{15}$ fatty alcohol condensed with 5 moles propylene oxide and 10 moles ethylene oxide. Another group of low foam liquid nonionics are available from Shell Chemical Company, Inc. under the Dobanol trademark: Dobanol 91-5 is a low foam ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide.

Other useful surfactants are Neodol 25-7 and Neodol 25-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven mols of ethylene oxide and the latter is a similar product but with nine mols of ethylene oxide being reacted.

A preferred nonionic surfactant is available from Union Carbide Corporation under the trademark Tergitol MDS-42. This nonionic surfactant is a $C_{12}$–$C_{14}$ linear alcohol containing 55% by weight random distributed oxyalkyl groups of which 42% are ethoxy and 58% propoxy groups.

Other useful nonionic surfactants are the Poly-Tergent S-LF surfactants available from Olin Corporation. These surfactants are low foaming, biodegradable linear fatty alcohols. Surfactants of this type are available under the tradenames Poly-Tergent S-LF 18, Poly-Tergent S-305-LF, Poly-Tergent S-405-LF and Poly-Tergent CS-1.

Mixtures of two or more of the liquid nonionic surfactants can be used and in some cases advantages can be obtained by the use of such mixtures.

The detergent active materials used herein must be stable in the presence of chlorine bleach, especially hypochlorite bleach. In addition to the above discussed nonionic surfactants, anionic surfactants can also be used.

The anionic surfactants that can be used are the linear or branched alkali metal mono- and/or di-($C_{8-14}$) alkyl diphenyl oxide mono and/or disulphonates, commercially available for example as DOWFAX (Registered Trademark) 3B-2 and DOWFAX 2A-1.

Other suitable surfactants include the primary alkylsulphates, alkylsulphonates, alkylaryl-sulphates and sec. alkylsulphates. Examples include sodium $C_{10-18}$ alkyl sulphates such as sodium dodecyl sulphate and sodium tallow alcohol sulphate; sodium $C_{10-18}$ alkane sulphonates such as sodium hexadecyl sulphonate and sodium $C_{12-18}$ alkylbenzene sulphonates such as sodium dodecylbenzene sulphonates. The corresponding potassium salts may also be employed.

The nonionic and anionic surfactants are used in amounts of 0.1 to 5.0%, for example about 0.5 to 0.3%, preferably about 0.3 to 2.0%.

Various conventional ingredients may be included in these compositions in small amounts, generally less than about 3 wt. %, such as perfume, hydrotropic agents such as the sodium benzene, toluene, xylene and cumene sulphonates, preservatives, dyestuffs and pigments and the like, all of course being stable to chlorine bleach compound and high alkalinity (properties of all the components). Especially preferred for coloring are the chlorinated phthalocyanines and polysulphides of aluminosilicate which provide, respectively, pleasing green and blue tints.

The aqueous liquid LADD compositions of this invention are readily employed in known manner for washing dishes, glasses, cups, cookware, eating utensils and the like in an automatic dishwasher, provided with a suitable detergent dispenser, in an aqueous wash bath containing an effective amount of the detergent composition.

The amount of water contained in these compositions should, of course, be neither so high as to produce unduly low viscosity and high fluidity, nor so low as to produce unduly high viscosity and low fluidity, thixotropic properties in either case being diminished or destroyed. Such amount is readily determined by routine experimentation in any particular instance, generally ranging from about 25 to 75 wt. %, preferably about 50 to 60 wt. %. The water should also be preferably be deionized or softened. These amounts of water in the composition include the water added as part of the liquid solutions or of other ingredients, but do not include bound water, for example that in NaTPP hexahydrate.

In an embodiment of the invention a concentrate automatic dishwashing detergent composition is formulated using the below named ingredients.

| Component | Weight Percent |
|---|---|
| Water | 25–75 |
| Sodium Tripolyphosphate | 20–30 |
| Sodium Carbonate | 3–10 |
| Sodium Hydroxide (50%) | 2–9 |
| Surfactant | 0.5–3 |
| Sodium Silicate | 15–40 |
| Insoluble Bromide Compound or Encapsulated Bromide Compound in an amount sufficient to provide a mole ratio of bromide to available chlorine of | 0.04 to 1.04[1] |
| Sodium Hypochlorite (Available Chlorine) | 1 to 4[2] |
| Fatty Acid or Salt Thixotropic Thickener | 0.03–2.5 |
| Color, Perfume | 0.5 to 2.5 |

[1]1.4 to 102 milli mole % bromide.
[2]28 to 113 milli mole % chlorine.

The dishwasher detergent compositions of the present invention can contain conventional dishwashing detergent composition additives. The formulations can be prepared with commercially available powder builders, chlorine bleach source compounds and insoluble or slightly soluble bromide compounds.

The aqueous liquid formulations, for example the nonthixotropic formulations, can be prepared using the conventional blending and mixing procedures used for the preparation of aqueous liquid detergent compositions. Suitable mixing procedures that can be used are described in Drapier et al U.S. Pat. No. 4,752,409 and in applicants' prior application U.S. Ser. No. 323,138, filed Mar. 13, 1989, both of which are incorporated herein in their entirety by reference thereto.

The method of mixing the ingredients of the compositions of the present invention can be conventionally mixing procedures. The bromide compound or the encapsulated bromide compound is added during the last mixing step.

The dual bleach system of the present invention can also be incorporated in the aqueous liquid viscoelastic automatic dishwasher compositions described in the copending related application of Dixit et al U.S. Ser. No. 353,712, filed May 18, 1989, which is incorporated herein by reference thereto.

The thixotropic aqueous liquid automatic dishwasher detergent compositions of the present invention can contain conventional dishwashing detergent additives. The formulations can be prepared with commercially available solid powder builders, and/or the ingredients can be mixed and the formulations ground to a desired particle size. All amounts and proportions referred to herein are percent by weight of the composition unless otherwise indicated.

The invention may be put into practice in various ways and a number of specific embodiments will be described to illustrate the invention with reference to the accompanying examples.

EXAMPLE 1

In accordance with the present invention aqueous liquid automatic dishwasher detergent compositions are formulated using the below named ingredients in the amounts indicated.

| Ingredients | Concentrated Composition | Comparison Composition |
|---|---|---|
| Deionized Water | 39.918 | 41.418 |
| Sodium Silicate(1) | 17.240 | 17.240 |
| Sodium TPP-Anhydrous | 12.000 | 12.000 |
| Sodium TPP-Hydrated | 12.000 | 12.000 |
| Sodium Hydroxide (50%) | 2.400 | 2.400 |
| Sodium Hypochlorite (13%)(2) | 7.400 | 7.400 |
| Resin Quaternaryammonium Bromide(3) | 1.500 | — |
| Sodium Carbonate | 5.000 | 5.000 |
| Gel White H Clay(4) | 1.250 | 1.250 |
| Aluminum Stearate(4) | 0.130 | 0.130 |
| Doxfax 3B2 Surfactant(5) | 1.000 | 1.000 |
| LPKN 158 Defoamer(6) | 0.160 | 0.160 |
| Graphtol Green Pigment | 0.002 | 0.002 |
| | 100.000 | 100.000 |

The fatty acid or fatty acid salt thixotropic agent is melted, and the ingredients are added to the water generally in the order listed, with the exception of the bromide compound which is added last. The ingredients are gently stirred as they are mixed until a homogeneous mixture is obtained.

1. 43.5% solution of 1:2.35 sodium silicate.
2. 1% available chlorine, 28 milli mole % chlorine.
3. Amberlite IRA 404 Resin quaternary ammonium bromide, ICSP #88-215, 4 to 4.2 milli moles of bromide per gram of resin. The resin is styrene crosslinked with 1% vinyl benzene. The 1.5 wt. % of the bromide compound contains 6 milli mole % bromide.
4. Thixotropic agents.
5. Na mono- and didecyl diphenyl disulfonate (45% solution).
6. Mixture of mono and disteary ($C_{16}$–$C_{18}$) alkyl esters of phosphoric acid, mole ratio 1:1.3.

The mole ratio of bromide to available chlorine in the invention composition is 0.21.

Multi-soil cleaning tests are run at stress conditions of 120° F. wash cycle temperature and 300 ppm hard water in a low performance dishwasher. This is done to show differences between the products which are less apparent in normal use conditions with tap water and 140° F. wash temperature.

Egg soil is prepared by mixing egg yolk with an equal amount of 2.5N calcium chloride solution. 0.4 grams of this mixture is applied to the usable surface of 7.5 inch china plates in a thin film. The plates are aged in 50% relative humidity overnight.

Oatmeal soil is prepared by boiling 24 grams of Quaker Oates in 400 ml of tap water for ten minutes. 3 grams of this mixture is spread onto a 7.5 inch china plate. The plates are aged for 2 hours at 80° C. They are then stored overnight at room temperature. Two plates are used per wash.

The plates are always placed in the same position in the dishwasher.

There is added 80 grams of each of the detergent products to be tested at the beginning of the wash cycle. All plates are scored by measuring the percent area cleaned.

The multi-soil cleaning test results are reported in the table below:

TABLE 1a

| Product | Soil Removal Wt. % Egg | Soil Removal Wt. % Starch |
|---|---|---|
| Comparison Composition (control) | 55 | 10 |
| Concentrated Composition | 36 | 32 |

The above aqueous liquid compositions are also tested cleaning glass tumblers.

The ASTM Method D3556-79 for the deposition on glassware during mechanical dishwashing is used to evaluate the buildup of spots and film on glassware. 80 gm each of the comparison composition and the invention composition is used in each test. All testing is done in Kenomore Model 587.1548580 and/or model 587.1546580 Automatic Dishwasher. The water wash temperature is 120° F. and the water has 300 ppm hardness. The below results are the average of four washes using 6 to 10 glass tumblers per wash.

TABLE 1b

| | Spot | Film |
|---|---|---|
| Comparison Liquid (control) | 2.5 | 3.0 |
| Concentrated Liquid | 2.0 | 2.0 |

The invention composition gives better results with regard to spot and film.

Spot/Film Scale
Spot On Glasses
1=no spots
2=1–2 spots
3=25 percent of glass covered with spots
4=50 percent of glass covered with spots
5=100 percent of glass covered with spots
Film On Glasses
1=best—no film
2=film slightly apparent
3=increase in noticeable film
4=filming significant
5=filming becoming excessive
6=filming highly excessive

EXAMPLE 2

Following the teachings of the present invention, liquid automatic dishwasher detergent compositions are formulated using the ingredients of the Example 1 comparison formulation. The amount of the resin quaternaryammonium bromide compound is varied between 0 and 6.0 wt. %. There are six formulations prepared. The water concentration is varied to adjust for the difference in resin quaternaryammonium bromide compound concentration.

The soiled dishware is prepared following the procedure of Example 1 except that porridge is substituted for the oatmeal. The multi-soil cleaning test is carried out following the procedure of Example 1, but using GE Model GSD 1200G Automatic Dishwasher at 120° F. wash temperature and tap water with about 110 ppm water hardness.

The information obtained is reported in the below table.

TABLE 2

| | Wt. % Available Chlorine | Wt. % Resin QNBr Compound | Wt. % Porridge Removal | Wt. % Egg Removal | Mole Ratio Bromide To Avail. Chlorine |
|---|---|---|---|---|---|
| Comparison Comp. | 1.0 | — | 10 | 55 | — |
| Invention Comp. | 1.0 | 1.0 | 25 | 53 | 0.143 |
| Invention Comp. | 1.0 | 1.5 | 33 | 36 | 0.214 |
| Invention Comp. | 1.0 | 2.0 | 40 | 18 | 0.286 |
| Invention Comp. | 1.0 | 4.0 | 90 | 4 | 0.571 |
| Invention Comp. | 1.0 | 6.0 | 95 | 3 | 0.857 |

The above information illustrates the effect on the removal of proteineous soil and starch carbohydrate soil by varying the mole ratio of Resin QNBr compound to available chlorine in the formulation.

EXAMPLE 3

The above Example 2 is repeated with the exception that sufficient sodium hypochlorite is added for the compositions to contain 1.5% available chlorine.

The information obtained is reported in the below table.

TABLE 3

| | Wt. % Available Chlorine | Wt. % Resin QNBr Compound | Wt. % Porridge Removal | Wt. % Egg Removal | Mole Ratio Bromide To Avail. Chlorine |
|---|---|---|---|---|---|
| Comparison Comp. | 1.5 | — | 12 | 70 | — |
| Invention Comp. | 1.5 | 1.0 | 23 | 60 | 0.095 |
| Invention Comp. | 1.5 | 1.5 | 30 | 55 | 0.143 |
| Invention Comp. | 1.5 | 2.0 | 45 | 54 | 0.190 |
| Invention Comp. | 1.5 | 4.0 | 85 | 40 | 0.381 |
| Invention Comp. | 1.5 | 6.0 | 90 | 20 | 0.571 |

The above information illustrates the effect on the removal of proteineous material and starch material by increasing the amount of available chlorine in the formulations.

EXAMPLE 4

The Example 1 formulation was prepared following the teachings of the present invention with the following exceptions. A long chain quaternary ammonium bromide cetyltrimethylammonium bromide (CTAB) was substituted for the Amberlite IR 404 bromide compound of Example 1. Formulations were prepared at concentrations of CTAB of 0.5, 0.9 and 1.8. The available chlorine concentration of 1.0 was maintained. The water concentration was varied to adjust for the difference in the CTAB concentration.

The formulations are tested against denatured egg and baked on oatmeal at about 130° F. and at 140° F. tap water wash temperatures in a GE machine.

The information obtained is reported in the below table.

TABLE 5

| | Wash Temp. | Wt. % Available Chlorine | Wt. % CTAB Compound | Wt. % Porridge Removal | Wt. % Egg Removal | Mole Ratio Bromide To Available Chlorine |
|---|---|---|---|---|---|---|
| Comparison Comp. | 140° F. | 1%(1) | — | >10 | 95 | — |
| Invention Comp. | 140° F. | 1% | 1.8(2) | 100 | 89 | 0.201 |
| Invention Comp. | 132° F. | 1% | 0.9 | 100 | 90 | 0.100 |
| Invention Comp. | 132° F. | 1% | 0.5 | 100 | 92 | 0.056 |

(1)The 1 wt. % available chlorine concentration is equivalent to 28 milli mole % chlorine.
(2)The 1.8% CTAB compound is equivalent to 5.63 milli mole bromide.

The above information illustrates that the invention compositions containing 0.5 to 1.8% CTAB completely remove the starch soil and substantially removes all of the protein soil.

EXAMPLE 5

In accordance with the present invention a concentrated aqueous liquid dishwasher detergent composition is formulated using the below named ingredients for hand washing of dishes. The formulation is prepared by simply mixing the ingredients in the order listed.

| Ingredient | Weight % |
|---|---|
| Deionized Water | 45.700 |
| Sodium Silicate(1) | 17.240 |
| Sodium TPP-Anhydrous | 12.000 |
| Sodium TPP-Hydrated | 12.000 |
| Sodium Hydroxide (50%) | 2.400 |
| Sodium Dichloroisocyanurate(2) | 2.700 |
| Cetyltrimethylammonium Bromide(3) | 1.800 |
| Sodium Carbonate | 5.000 |
| Dowfax 3B2 Surfactant(4) | 1.000 |
| LPKN 158 Defoamer(5) | 0.160 |
| | 100.00 |

(1)43.5% solution of 1:2.35 sodium silicate.
(2)Contains 1.5 wt. % available chlorine which is equivalent to 42 milli mole % chlorine
(3)Contains 1.8 wt. % bromide which is equivalent to 6 milli mole % of bromide.
(4)Na mono and didecyldiphenyl disulfonate 45% solution.
(5)Mixture of mono and distearyl ($C_{16}$-$C_{18}$) alkyl esters of phosphoric acid, mole ratio 1:1.3.

The mole ratio of bromide ion to available chlorine is 0.143.

About 60 cc of the above liquid is used in 600 cc of 80° F. wash water to hand wash soiled dishes containing proteinaceous egg soil and baked on starchy carbohydrate pasta soil. The dishes with little cleaning effort were completely cleaned by the removal of all of the egg and pasta soil.

EXAMPLE 6

In accordance with another embodiment of the present invention an aqueous liquid automatic dishwasher detergent composition is formulated in which the bromide source compound used consists of NaBr and/or $CaBr_2$ encapsulated in a protective coating of microcrystalline wax that is insoluble in the product liquid. The microcrystalline wax used has a melting temperature of 120° F. When the composition is added to a water wash bath at a temperature of 120° F. the microcrystalline coating material melts in the larger volume of warm wash bath water to release the sodium bromide and calcium bromide which is readily water soluble. The sodium bromide and/or calcium bromide reacts with the hypochlorite to form the active hypobromite.

The formulations contain the following ingredients.

| Ingredients | Weight % |
|---|---|
| Deionized Water | 41.1 to 38.6 |
| Sodium Silicate | 17.24 |
| Sodium TPP (Anhydrous) | 24.00 |
| Sodium Hydroxide (50%) | 2.40 |
| Sodium Hypochlorite (13%)(1) | 7.40 |
| Sodium Bromide/Calcium Bromide(2) | 0.5 to 3.0 |
| Sodium Carbonate | 5.00 |
| Gel White H Clay(3) | 1.00 |
| Stearic Acid(3) | 0.20 |
| Dowfax 3B2 Surfactant | 1.00 |
| LPKN 158 Defoamer | 0.16 |
| | 100.00 |

(1)Available chlorine 1 wt. %, which is equivalent to 28 milli mole % chlorine.
(2)0.5 to 3 wt. % sodium bromide is equivalent to 4.9 to 29 milli mole % bromide and 1.5 wt. % calcium bromide is equivalent to 15 milli mole % bromide
(3)Thixotropic agents.

The bromide compounds are encapsulated following the procedure of Britchard U.S. Pat. No. 4,421,669.

The soiled dishware are prepared following the procedure of Example 1 except that porridge is substituted for the oatmeal.

The multisoil cleaning test is carried out following the procedure of Example 1, except that a GE Model GSD 1200G automatic dishwasher is used, at 120° F. tap water wash temperature.

The information obtained is reported in the below table.

TABLE 5

| | Wt. % Available Chlorine | Wt. % Bromide Compound | Wt. % Porridge Removal | Wt. % Egg Removal | Mole Ratio Bromide Ion To Available Chlorine |
|---|---|---|---|---|---|
| Comparison Comp. | 1.0 | — | 70 | 90 | — |
| Invention Comp. | 1.0 | 3.0 NaBr(1) | 100 | — | 1.041 |
| Invention Comp. | 1.0 | 1.5 NaBr(1) | 100 | — | 0.521 |
| Invention Comp. | 1.0 | 1.5 $CaBr_2$ 1.5 NaBr | 100 | 49 | 0.804 |
| Invention Comp. | 1.0 | 1.5 $CaBr_2$ | 100 | 82 | 0.268 |
| Invention Comp. | 1.0 | 1.0 NaBr | 100 | 70 | 0.347 |
| Invention Comp. | 1.0 | 0.5 NaBr | 98 | 83 | 0.174 |

(1)Egg soils are not used in these runs.

The above information shows that the bromide enhanced bleach completely clean porridge soil, even at the lower 0.5% NaBr, whereas 49 to 83% of the egg soil is removed.

The dual bleach aqueous liquid automatic dishwashing detergent compositions of the present invention provided improved removal of proteinaceous soils and starchy carbohydrate soils.

The invention is not to be limited by the above disclosure and examples which are given as illustrations only. The invention is to be interpreted in accordance with the below claims.

What is claimed is:

1. A dual bleach aqueous liquid automatic dishwasher composition comprising approximately by weight:

a. 8–40% inorganic detergent builder;
b. 2.5–40% alkali metal silicate;
c. 0 to 30% alkali metal carbonate;
d. 0.1 to 5% chlorine bleach stable, water-soluble dispersible inorganic detergent active material;
e. 0 to 5% chlorine bleach stable foam depressant;
f. a chlorine bleach compound capable of forming a hypochlorite ion upon contact with water, said chlorine bleach compound being present in an amount sufficient to provide about 0.5 to 5% of available chlorine;
g. a sufficient amount of a water soluble or sparingly water soluble bromide compound selected from the group consisting of a quaternary ammonium bromide compound and a quaternary phosphonium bromide compound, said bromide compound being encapsulated within a water insoluble protective coating having a melting point between 38° C. and 60° C. to provide a mole ratio of available bromide to available chlorine of 0.04 to 1.04%, said quaternary ammonium bromide compound being characterized by the formula:

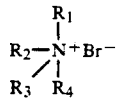

wherein $R^1$ is a $C_{12}$ to $C_{22}$ alkyl group, $R^2$ is a $C_{11}$ to $C_{22}$ alkyl group, $R^3$ is a $C_1$ to $C_4$ alkyl group and $R_4$ is a $C_1$ to $C_4$ alkyl group and said quaternary phosphonium bromide compound being characterized by the formula:

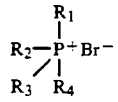

wherein $R^1$ is a $C_{12}$ to $C_{22}$ alkyl group or a phenyl group, $R^2$ is a $C_1$ to $C_{22}$ alkyl group or phenyl group, $R^3$ is a $C_1$ to $C_4$ alkyl group or phenyl group and $R_4$ is a $C_1$ to $C_4$ alkyl group; (h) 0 to 12% sodium hydroxide; and (i) balance being water, said water being present in a sufficient amount that the apparent viscosity of said composition at room temperature measured in a Brookfield viscosimeter HATD, using a number 4 spindle at 20 rpms is less than about 20,000 cps.

2. The composition of claim 1, wherein the chlorine bleach compound is a member selected from the group of chlorocyanurates, chloroisocyanurates, alkali and alkaline earth hypochlorites.

3. The composition of claim 1, further including 0.02 to 3.0 weight percent of a fatty acid thixotropic thickener.

4. The composition of claim 3, further including 0.1 to 3 weight percent of an inorganic thixotropic clay thickener.

5. The composition of claim 1, further including 1.5 to 8 weight percent of an inorganic thixotropic clay thickener.

6. A dual bleach aqueous liquid automatic dishwasher composition comprising approximately by weight:

a. 8–40% inorganic detergent builder;
b. 2.5–40% alkali metal silicate;
c. 0 to 30% alkali metal carbonate;
d. 0.1 to 5% chlorine bleach stable, water-soluble dispersible inorganic detergent active material;
e. 0 to 5% chlorine bleach stable foam depressant;
f. a chlorine bleach compound capable of forming a hypochlorite ion upon contact with water, said chlorine bleach compound being present in an amount sufficient to provide about 0.5 to 5% of available chlorine;
g. a sufficient amount of a water soluble alkali or alkaline earth metal bromide being encapsulated within a water insoluble protective coating have a melting point between 38° C. and 60° C. to provide a mole ratio of available bromide to available chlorine of 0.04 to 1.04%;
h. 0 to 12% sodium hydroxide; and
i. balance being water, said water being present in a sufficient amount that the apparent viscosity of said composition at room temperature measured in a Brookfield viscosimeter HATD, using a number 4 spindle at 20 rpms is less than about 20,000 cps.

7. The composition of claim 6, wherein the chlorine compound is sodium dichloroisocyanurate or sodium trichloroisocyanurate or mixtures thereof.

8. The composition of claim 7, wherein the bromide compound is encapsulated with a microcrystalline wax or a paraffin wax that melts at a temperature of 120° to 140° F.

9. The composition of claim 6, wherein the chlorine compound is a member of the group consisting of sodium hypochlorite, calcium hypochlorite and lithium hypochlorite.

10. The composition of claim 9 wherein the chlorine compound is in an amount of 1 to 10 wt. %.

11. The composition of claim 10, wherein the bromide compound or encapsulated bromide compound is in an amount sufficient to provide a mole ratio of bromide to available chlorine of 0.05 to 0.095.

12. The composition of claim 6, further including 0.02 to 3.0 weight percent of a fatty acid thixotropic thickener.

13. The composition of claim 12, further including 0.1 to 3 weight percent of an inorganic thixotropic clay thickener.

14. The composition of claim 6, further including 1.5 to 8 weight percent of an inorganic thixotropic clay thickener.

15. A method for cleaning soiled dishware which contain both proteinaceous soils and carbohydrate soils which comprises contacting the soiled dishware in an automatic dishwashing machine in an aqueous wash-bath having dispersed therein an effective amount of the composition of claim 1 to obtain clean dishware reduced in proteinaceous soils and carbohydrate soils.

16. A method for cleaning soiled dishware which contain both proteinaceous soils and carbohydrate soils which comprises contacting the soiled dishware in an automatic dishwashing machine in an aqueous wash-bath having dispersed therein an effective amount of the composition of claim 6 to obtain clean dishware of reduced in proteinaceous soils and carbohydrate soils.

* * * * *